US005267416A

United States Patent [19]

Davis

[11] Patent Number: 5,267,416

[45] Date of Patent: Dec. 7, 1993

[54] WINDOW SASH COUNTERBALANCE WITH VARYING LIFT

[75] Inventor: Donald D. Davis, Rochester, N.Y.

[73] Assignee: Caldwell Manufacturing Company, Rochester, N.Y.

[21] Appl. No.: 914,256

[22] Filed: Jul. 15, 1992

[51] Int. Cl.[5] ..... E05F 1/00

[52] U.S. Cl. ..... 49/447; 16/197; 49/445

[58] Field of Search ..... 49/447, 445, 446; 16/197, DIG. 16, 193

[56] References Cited

U.S. PATENT DOCUMENTS

| | | | |
|---|---|---|---|
| 2,041,646 | 5/1936 | Larson . | |
| 2,415,614 | 2/1947 | Tappan . | |
| 2,477,069 | 7/1949 | Larson . | |
| 2,565,804 | 8/1951 | DeVries et al. | 16/197 |
| 2,580,705 | 1/1952 | Tappan . | |
| 2,604,655 | 7/1952 | Peremi . | |
| 2,622,267 | 12/1952 | Peremi | 16/197 |
| 2,702,920 | 3/1955 | DeVries et al. | 16/197 |
| 2,776,447 | 1/1957 | Addicks | 16/197 |
| 2,793,389 | 5/1957 | Larson . | |
| 2,825,088 | 3/1958 | Decker et al. | 16/197 |
| 2,851,721 | 9/1958 | Decker et al. | 16/197 |
| 2,943,345 | 7/1960 | Ammerman . | |
| 3,271,812 | 9/1966 | Skolnik . | |
| 3,286,301 | 11/1966 | Skolnik . | |
| 3,844,066 | 10/1974 | Nobes . | |
| 4,423,536 | 1/1984 | Cross | 16/197 |
| 4,452,012 | 6/1984 | Deal . | |
| 4,517,766 | 5/1985 | Haltof . | |
| 5,152,032 | 10/1992 | Davis et al. | 16/197 |

FOREIGN PATENT DOCUMENTS

| | | |
|---|---|---|
| 465925 | 5/1937 | United Kingdom . |
| 819094 | 8/1959 | United Kingdom . |

OTHER PUBLICATIONS

Instruction Sheet for Tilt/Takeout System: "Field Adjustment Procedures for Single or Tandem Balances'-'-Caldwell Manufacturing Company, Rochester, NY.

*Primary Examiner*—Peter M. Cuomo
*Assistant Examiner*—Michael Milano
*Attorney, Agent, or Firm*—Eugene Stephens & Associates

[57] ABSTRACT

A multiple spring counterbalance includes a torsion spring and a tension spring for exerting a combined lifting force on a window sash. A spiral rod is threadably engaged with a follower nut for converting a torque applied by the torsion spring into a lifting force on the window sash. The spiral rod has a pitch that is varied along one part of its length to produce a substantially constant combined lifting force throughout most of a range of sash travel between a lowered position and an intermediate position. However, the pitch is further varied along another part of the length of the spiral member to produce a larger combined lifting force within a remaining portion of the range of sash travel from the intermediate position to the raised position.

12 Claims, 5 Drawing Sheets

WINDOW SASH COUNTERBALANCE WITH VARYING LIFT

BACKGROUND

Window sash counterbalances offset at least part of the weight of window sashes to make the sashes easier to lift and to hold the sashes stationary in various positions along a range of sash travel within a window frame. The window sash weight is offset by a lifting force that is maintained as uniform as possible throughout the range of sash travel to minimize opposite conditions of sash "hop" and sash "drop".

Too much lifting force causes the sashes to undesirably rise or "hop" from a position within the sash travel range. Too little lifting force allows the sashes to fall or "drop" from a position within the same range. However, friction within the sash counterbalances and between the sashes and frames compensates for some variation in the lifting force by providing a controlled resistance to any movement of the sashes within the frames.

Although some friction is desirable to compensate for variations in the lifting force, excessive friction can make the sashes difficult to move. Accordingly, both the friction and the variations in the lifting force are limited to obtain optimum overall performance of the sash counter-balances. For example, torsion spring balances can be used as window sash counterbalances to provide a nearly uniform amount of lifting force throughout the range of sash travel.

U.S Pat. No. 2,580,705 to Tappan discloses an example of a torsion spring balance including a torsion spring having one end secured against rotation and a follower nut attached to the other end for imparting angular movement between the two ends. A spiral rod having a varying pitch is threadably engaged with the follower nut for transforming a torque applied by the torsion spring into a lifting force against a window sash. The pitch of the spiral rod is varied to compensate for changes in the torque applied by the torsion spring.

U.S. Pat. No. 2,041,646 to Larson discloses an example of a tension spring combined with a torsion spring balance to provide additional lift capacity. The lifting force of the torsion spring balance is varied to compensate for variations in the lifting force of the tension spring throughout the range of sash travel. A spiral rod member of of the torsion spring varies in pitch to provide a decreasing amount of lift as the tension spring is extended.

SUMMARY OF INVENTION

My invention improves upon the performance of torsion spring balances by providing an additional lifting force limited to an upward end of a range of sash travel. The additional lifting force helps to prevent sash drop at the upward end of sash travel for holding bottom window sashes of double-hung windows fully open and for holding upper sashes of the same windows fully closed.

The upper sashes of double-hung windows can be forced open by friction between rails of the two sashes when the lower sash is closed. However, the additional lifting force is preferably sized to overcome this friction between sash rails to maintain the upper sash in a closed position. Elsewhere along the range of sash travel, a relatively constant lower lifting force is maintained to resist conditions of sash hop and sash drop.

One example of my new sash balance for offsetting weight of a window sash throughout a range of sash travel between lowered and raised positions includes a torsion spring having two ends for applying a torque between the two ends as a function of an angular movement between the ends. An anchor holds one end of the torsion spring against rotation, and a follower is connected to the other end of the spring for imparting angular movement between the two ends. A spiral member having a pitch that varies along the length of the member is threadably engaged with the follower for transforming the torque applied by the torsion spring into a lifting force against the sash.

The pitch of the spiral member is varied along one part of the length of the spiral member to produce a substantially constant lifting force throughout most of the range of sash travel between the lowered position and an intermediate position. However the pitch is further varied along another part of the length of the spiral member to produce a larger lifting force within a remaining portion of the range of sash travel from the intermediate position to the raised position. Preferably, the remaining portion of the range of sash travel includes no more than twenty percent of the total range of travel between the lowered and raised positions.

Another example of my invention is embodied in a multiple spring window sash counterbalance for applying a predetermined lifting force to a window sash throughout a range of counterbalance travel from a fully retracted position to a fully extended position. A tension spring assembly applies a first lifting force to the sash, and a torsion spring assembly applies a second lifting force to the same sash. The two lifting forces are combined to apply (a) a substantially constant lifting force throughout most of the range of counterbalance travel from the fully extended position to an intermediate position and (b) a larger lifting force within the remaining portion of the range of counterbalance travel from the intermediate position to the fully retracted position.

DRAWINGS

DETAILED DESCRIPTION

Figure 1:
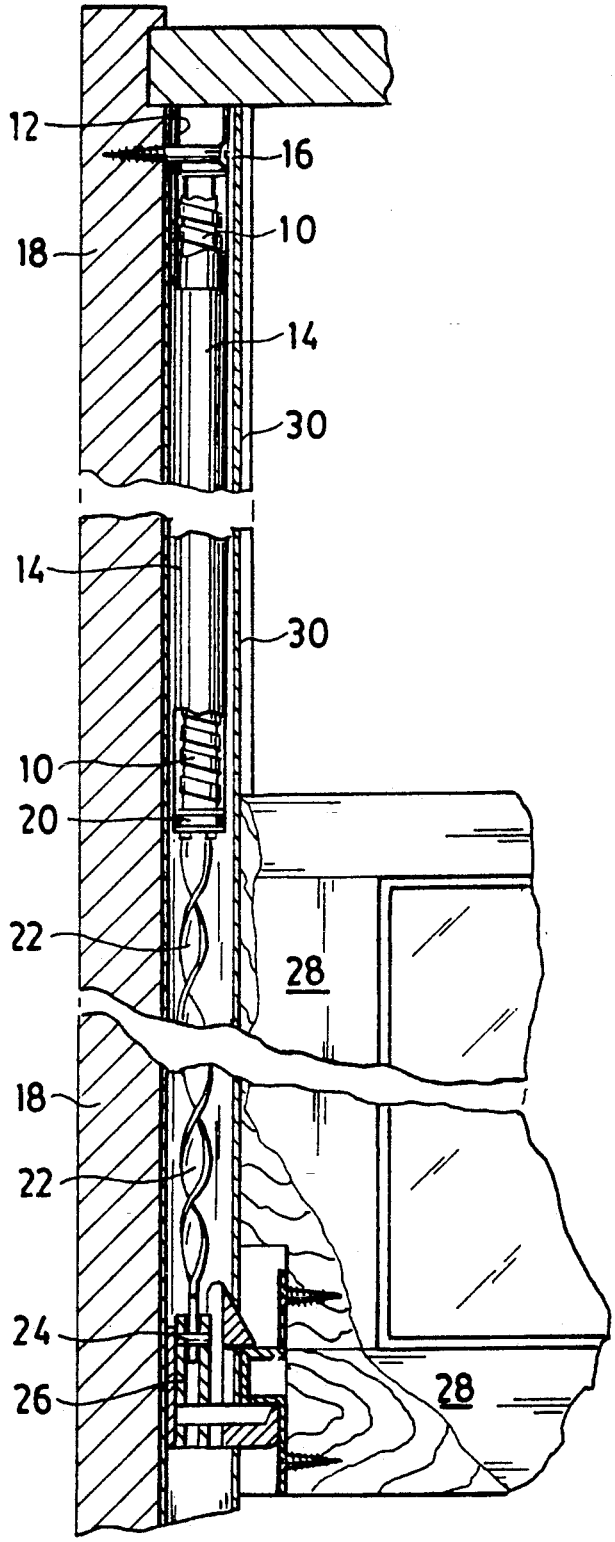
FIG. 1 is a partly cut away front elevational view of one embodiment of my invention as a torsion spring balance mounted between a window frame and an upper window sash.

A first embodiment of my invention, which is illustrated in FIG. 1, incorporates several conventional features of torsion spring balances. The conventional features include a torsion spring 10 having two ends. An anchor 12 attaches one end of the torsion spring 10 to one end of a rigid tube 14 for preventing rotation of the attached spring end. A screw 16, passing through both the anchor 12 and the tube 14, connects the balance to a window frame 18.

A follower nut 20 is journalled within the other end of the tube 14 and is connected to the other end of the torsion spring 10 for communicating angular movement between the two spring ends. A spiral rod 22 having a varying pitch threadably engages the follower nut 20 for transforming a torque produced between ends of the torsion spring 10 into a tensive force between the spiral rod 22 and the tube 14. An eyelet 24 through one end of the spiral rod 22, together with sash shoe 26, communicates the tensive force as a lifting force applied to an upper window sash 28.

The sash shoe 26 tracks within a window jamb liner 30 between (a) a fully retracted position of the balance corresponding to an uppermost position of the window sash 28 within the frame 18 and (b) a fully extended position of the balance corresponding to a lowermost position of the sash within the same frame. Throughout a range of balance travel between the fully retracted and fully extended positions corresponding to a range of window sash travel between the uppermost and lowermost positions, the pitch of the spiral rod 22 engaged with the follower nut 20 is varied to control the magnitude of the lifting force applied to the window sash.

Figure 2:
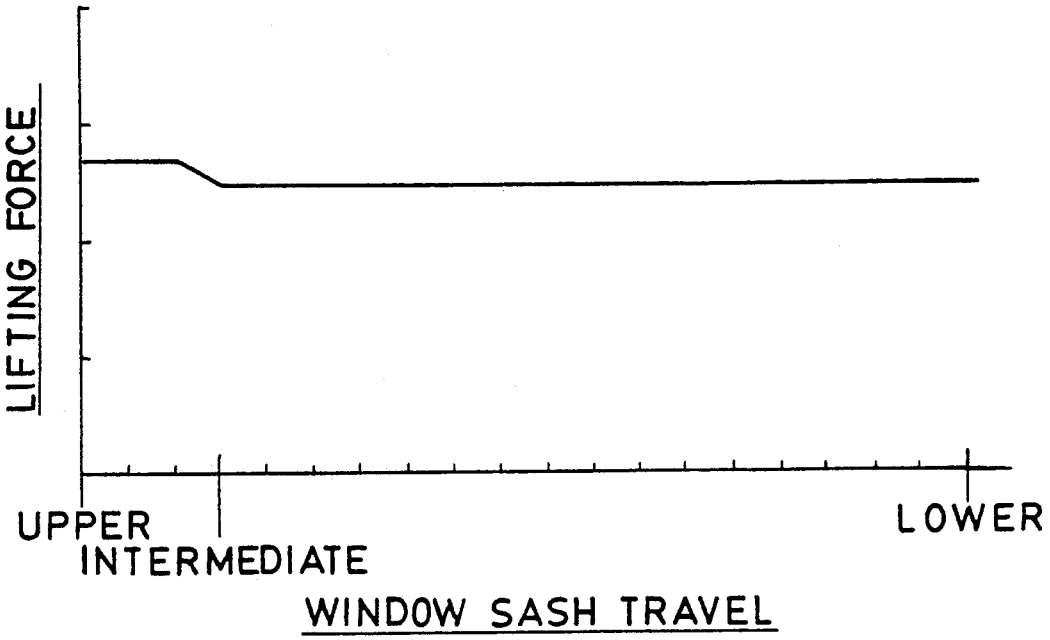
FIG. 2 is a graph of lifting force of the torsion spring balance as a function of sash travel distance.

Referring to FIG. 2, a graph is presented of balance lifting force over the range of window sash travel from the uppermost position to the lowermost position. Throughout most of the range of travel or at least throughout a more than one-half portion of this range from the lowermost position to an intermediate position, the lifting force remains substantially constant. Although the graph shows an even lifting force throughout the more than one-half portion of the range, ordinary lifting force variations that do not produce either sash hop or sash drop can also be regarded as substantially constant.

However, a larger lifting force is applied by the balance within the remaining portion of the range of sash travel from the intermediate position to the uppermost position. The larger lifting force is preferably at least five percent greater than the constant lifting force and most preferably about ten percent greater than the same. For most windows, the larger lifting force is preferably at least 5 newtons greater than the constant lifting force, and a lifting force of about 10 newtons is most preferred.

The remaining portion of the range of sash travel within which the larger lifting force is applied is also preferably limited to no more than twenty percent of the total range of travel between the uppermost and lowermost positions of the sash. For most windows, the remaining portion of the range of travel can be limited to a span between two centimeters and ten centimeters with preference given to a span between 4 centimeters and 6 centimeters.

Figure 3:
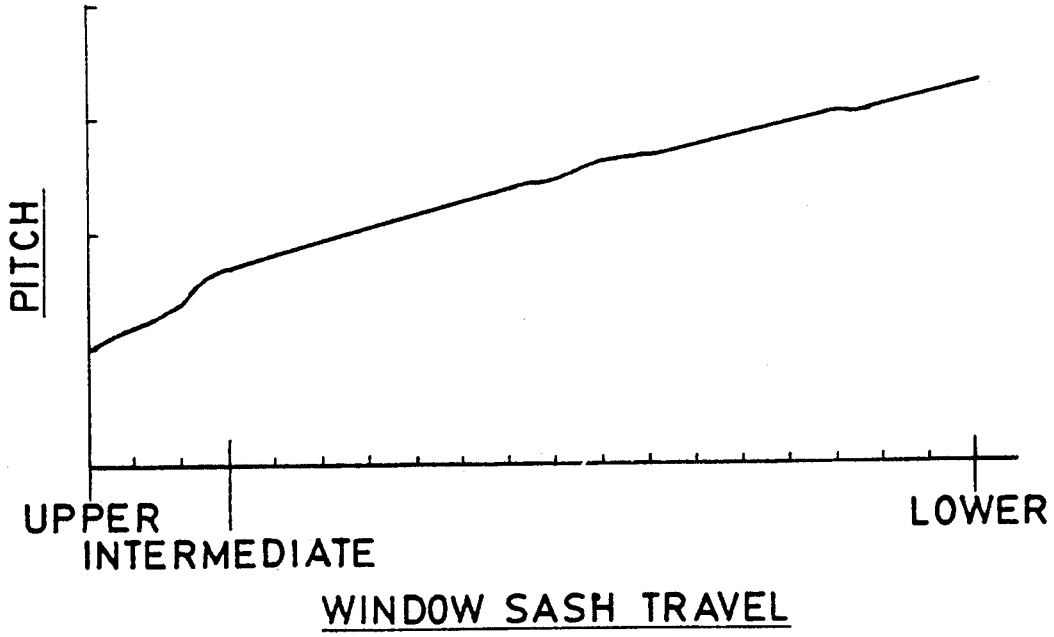
FIG. 3 is a graph of pitch of a spiral member of the torsion balance also as a function of sash travel distance.

FIG. 3 graphically depicts the variations in pitch required to achieve the lifting forces of FIG. 2 throughout the same range of sash travel. The pitch is determined along the range of travel at corresponding points of engagement on the spiral rod 22 with the follower nut 20.

Neglecting friction, which opposes both upward and downward motion of the window sash, a lifting force "L" is related to a torque "T" applied by the follower nut 20 and an instant pitch "z" by the following relationship:

$$L = \frac{2\,pi\,T}{z}$$

where "pi" is the known constant designating the ratio of the circumference of a circle to its diameter (i.e., 3.14159). The torque "T" can also be written in terms of a known spring constant "K" of the torsion spring 10 and the number of turns "y" between the ends of the spring as follows:

$$T = K\,y$$

Given a desired initial lifting force "$L_o$", spring constant "K", and either the initial turns "$y_o$" or the initial pitch "$z_o$", the remaining initial value can be calculated as follows:

$$z_o = \frac{2\,pi\,K\,y_o}{L_o} \qquad y_o = \frac{L_o\,z_o}{2\,pi\,K}$$

The pitch "z" and the turns "y" are related to a distance "x" of window sash travel by the following relationship:

$$dx = dy\,z$$

where "dx" is the differential of distance "x" and "dy" is the differential of turns "y".

The expression for pitch "z" can also be written as:

$$z = A\,y$$

by letting constant "A" equal the following ratio:

$$A = \frac{2\,pi\,K}{L_o}$$

Substituting for "z", the above differential equation can be rewritten as:

$$O = dx - A\,y\,dy$$

which has a general solution of:

$$C = x - (A/2)y^2$$

The constant "C" can be determined by substituting known values for initial distance "$x_o$" and initial turns "$y_o$". The above expression can also be rewritten for determining turns "y" as a function of distance "x" as follows:

$$y = \sqrt{\frac{2\,(x - C)}{A}}$$

The pitch "z" is also solvable directly in terms of distance "x" by appropriate substitution as follows:

$$z = \sqrt{2\,A\,(x - C)}$$

The above expressions for turns "y" and pitch "z" as functions of distance "x" assume a constant lifting force "L". However, the same expressions can be expanded to account for the illustrated change in the lifting force "L" between the higher and lower values of the lifting force "L" by writing the variable lifting force "L" also as a function of the distance "x". For example, the lifting force "L" can be rewritten as a linear equation as follows:

$$L=S\,x+L_o$$

where "S" is a given slope and "$L_o$" is an initial lifting force at distance "x" equal to zero.

The expression for pitch "z" is then rewritten as follows:

$$z=\frac{A\,y}{1+B\,x}$$

where constant "B" is equated as follows:

$$B=\frac{S}{L_o}$$

Substituting the new expression for pitch "z" into the above differential equation yields the following relationship between distance "x" and turns "y":

$$0=(1+B\,x)\,dx-A\,y\,dy$$

which has a general solution:

$$C=x+(B/2)\,x^2-(A/2)\,y^2$$

The turns "y" and pitch "z" are then solvable directly from the following expanded expressions that account for the variation in the lifting force:

$$y=\sqrt{\frac{B\,x^2+2\,x-2\,C}{A}}$$

and $$z=\frac{\sqrt{A\,B\,x^2+2\,A\,x-2\,A\,C}}{1+B\,x}$$

Figure 4:
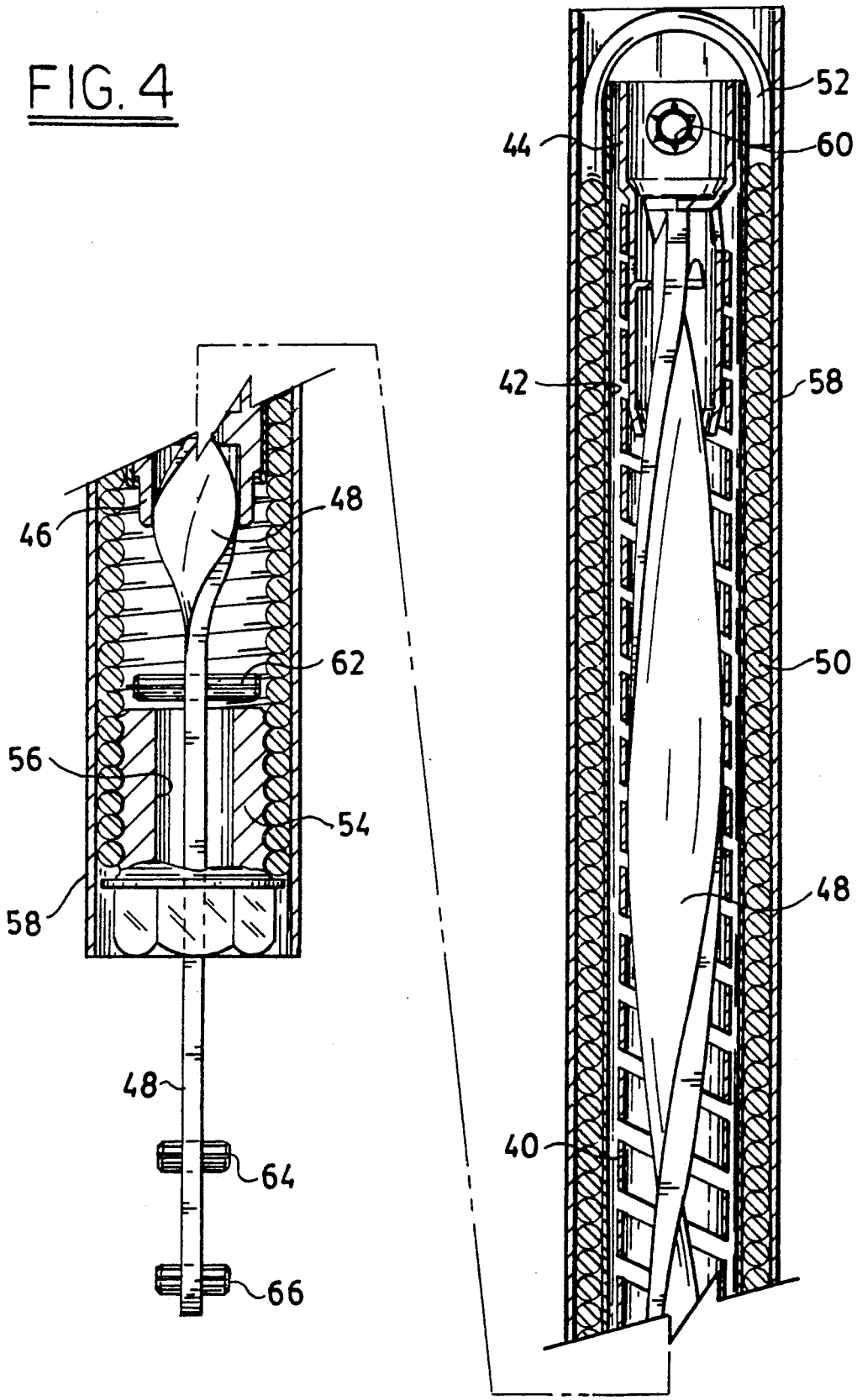
FIG. 4 is a partly cut away front elevational view of another embodiment of my invention as a multiple spring balance.

A second embodiment of my invention, illustrated by FIG. 4 as a multiple spring balance, incorporates many features of copending and commonly assigned U.S. application Ser. No. 704,804, filed May 23, 1991, for Window Sash Balance with Tension and Torsion Spring now U.S. Pat. No. 5,152,032. This application is hereby incorporated by reference for all of its relevant disclosure.

The multiple spring balance includes a torsion spring 40 mounted within an inner tube 42. An anchor 44 connects one end of the torsion spring 40 to one end of the inner tube 42. A follower nut 46, journalled within the other end of the inner tube 42, is connected to the other end of the torsion spring 40. A spiral rod 48 threadably engages the follower nut 46 for converting a torque applied by the torsion spring into a tensive force between the spiral rod 48 and the inner tube 42.

The inner tube 42, together with the torsion spring 40, is mounted within a tension spring 50. One end of the tension spring 50 has a ring 52 that fits over the anchor 44 of the torsion spring 40. The other end of the tension spring 50 is fitted with an anchor 54 that has an opening 56 through which the spiral rod 48 extends for attachment to a sash shoe (not shown).

An outer tube 58 encloses the tension spring 50 and helps to hold the ring 52 against the inner tube 42. An opening 60 is formed through the outer tube 58, the inner tube 42, and the anchor 44 for attaching the balance to a window frame with a screw fastener (not shown). An eyelet 62, extending through the spiral rod 48, is sized with respect to opening 56 in anchor 54 to form a stop limiting relative movement between the spiral rod 48 and the anchor 54. Accordingly, relative movement between the spiral rod 48 and the inner tube 42 in a direction that further winds the torsion spring 40 also extends the tension spring 50.

However, the eyelets 64 and 66, which also extend through the spiral rod 48, are sized for passage through the opening 56 in anchor 54 for connecting the spiral rod to the sash shoe. In particular, the eyelet 64 is positioned along the length of the spiral rod 48 for engagement with the sash shoe, thereby transmitting a lifting force applied by the multiple spring balance against a window sash. The eyelet 66 is positioned along the length of the spiral rod 48 for releasing the eyelet 66 from the sash shoe and for adjusting the torsion spring 50.

Figure 5:
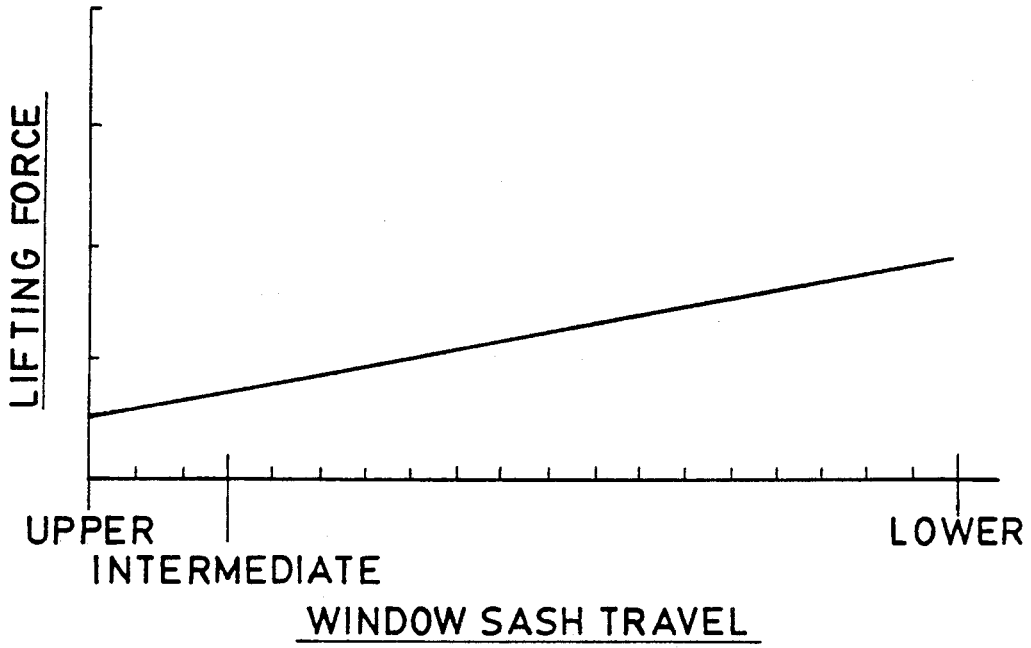
FIG. 5 is a graph of lifting force contributed by a tension spring of the multiple spring balance as a function of sash travel distance.
Figure 6:
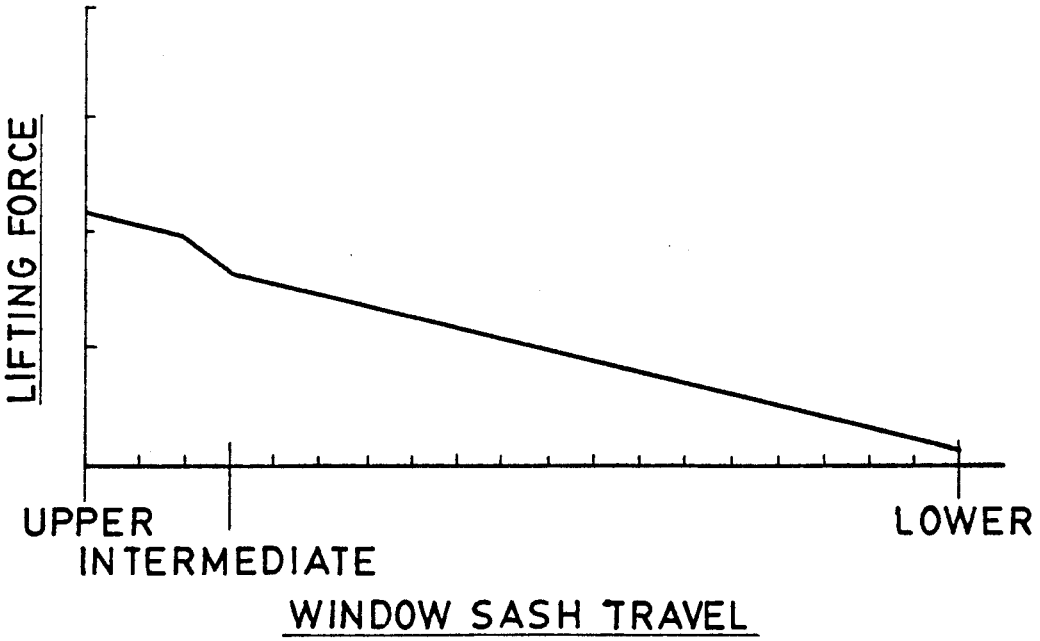
FIG. 6 is a graph of lifting force contributed by a torsion spring of the multiple spring balance as a function of sash travel distance.

FIGS. 5 and 6 show the respective lifting forces applied by the tension spring 50 and torsion spring 40 over a range of sash travel. The two lifting forces combine to produce a total lifting force similar to the lifting force of the preceding embodiment shown in FIG. 2.

The tension spring 50 is pretensioned to exert a substantial lifting force at an initial deflection from a fully retracted position. Thereafter, the lifting force of the tension spring increases in proportion to travel distance from the fully retracted position to a fully extended position.

The torsion spring 40 is wound to produce a large initial lifting force that is determined as a difference between the desired total lifting force and the lifting force of the tension spring 50. The spiral rod 48 of the torsion spring has a pitch that varies along its length to produce a substantially constant lifting force between the lowermost and intermediate positions of sash travel and a larger lifting force within the remaining range of sash travel between the intermediate and uppermost positions.

Figure 7:
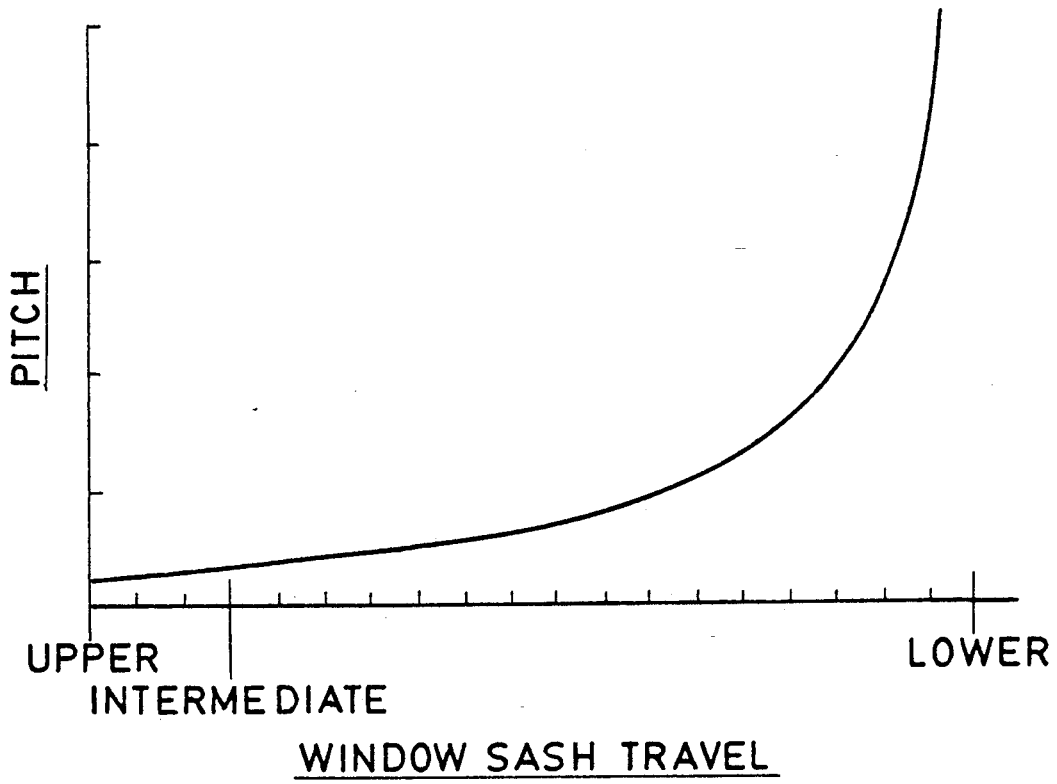
FIG. 7 is a graph of spiral member pitch of the torsion spring of the multiple spring balance also as a function of sash travel distance.

For example, FIG. 7 shows the pitch variations required to produce a total lifting force similar to the lifting force of FIG. 2. The pitch is initially varied along the length of the spiral rod 48 to maintain the desired larger total lifting force within the travel range between the uppermost and intermediate positions. The pitch is subsequently varied along an adjacent portion of the spiral rod to reduce the total lifting to the desired constant magnitude. Finally, the pitch is varied along a third portion of the spiral rod length to maintain the desired constant total lifting force throughout the main portion of the travel range between the intermediate position and the lowermost position.

The constant magnitude is maintained by decreasing the lifting force of the torsion spring in the same proportion that the lifting force of the tension spring increases throughout the same portion of the range. Thus, the torsion spring 40 not only produces a larger total lifting force within an upper portion of the range of sash travel but also compensates for variations in the lifting force of the tension spring 50 to maintain a substantially constant magnitude of total lifting force throughout the main portion of the range.

The same equations presented for the preceding embodiment can be used to calculate the pitch of spiral rod 48 as a function of sash travel distance by appropriately describing the desired amount of lift in terms of the sash travel distance. The parameters relating to the magnitude and position of the larger lifting force of the preceding embodiment also apply to the total lifting force of the multiple spring balance.

I claim:

1. A multiple spring window sash counterbalance for applying a lifting force to a window sash throughout a range of counterbalance travel from a fully retracted position to a fully extended position comprising:

a tension spring assembly for applying a first lifting force to the window sash;

a torsion spring assembly for applying a second lifting force to the window sash;

said torsion spring assembly including a torsion spring, a follower attached to the torsion spring, and a spiral rod engaged with said follower for converting a torque applied by the torsion spring into the second lifting force;

hardware for applying the first and second lifting forces as a combined lifting force to the window sash; and said spiral rod having a pitch that is varied so that the combined lifting force has a substantially constant magnitude throughout a more than one-half portion of the range of counterbalance travel from the fully extended position to an intermediate position and has a substantially larger magnitude within a remaining portion of the range of counterbalance travel from the intermediate position to the fully retracted position.

2. The counterbalance of claim 1 wherein the first lifting force increases in magnitude with increases in counterbalance travel distance from the fully retracted position to the fully extended position.

3. The counterbalance of claim 2 wherein the second lifting force decreases in magnitude with increases in the counterbalance travel distance from the intermediate position to the fully extended position.

4. The counterbalance of claim 3 wherein the magnitude of the first lifting force increases in proportion to the counterbalance travel distance from the fully retracted position to the fully extended position.

5. The counterbalance of claim 4 wherein the magnitude of the second lifting force decreases in the same proportion to the counterbalance travel distance throughout the more than one-half portion of the range of counterbalance travel from the intermediate position to the fully extended position.

6. The counterbalance of claim 5 wherein the magnitude of the second lifting force departs from the same proportion to the counterbalance travel distance within the remaining portion of the range of counterbalance travel from the intermediate position to the fully retracted position.

7. The counterbalance of claim 6 wherein the larger magnitude of the combined lifting force within the remaining portion of the range of counterbalance travel is at least two percent greater than the constant magnitude of the combined lifting force throughout the more than one-half portion of the range of counterbalance travel.

8. The counterbalance of claim 7 wherein the larger magnitude of the combined lifting force within the remaining portion of the range of counterbalance travel is at least 10 newtons greater than the constant magnitude of the combined lifting force throughout the more than one-half portion of the range of counterbalance travel.

9. The counterbalance of claim 6 wherein the more than one-half portion of the range of counterbalance travel from the fully extended position to the intermediate position includes at least eighty percent of the range of counter-balance travel between the fully extended position and the fully retracted position.

10. The counterbalance of claim 9 in which the remaining portion of the range of counterbalance travel the intermediate position and the fully retracted position is between 2 centimeters and 10 centimeters in length.

11. A multiple spring balance for applying a combined lifting force against a window sash throughout a range of travel of the window sash within a window frame comprising:

a tension spring having two ends for applying a first force between said two tension spring ends as a first function of a change in distance between said two tension spring ends;

one of said two tension spring ends being arranged for operative connection to the window frame, and the other of said two tension spring ends being arranged for operative connection to the window sash;

a torsion spring having two ends for applying a torque between said two torsion spring ends as a second function of a change in angular position rotation between said two torsion spring ends;

one of said two torsion spring ends being arranged for operative connection to one of the window frame and the window sash, and the other of said two torsion spring ends being connected to a follower;

a spiral member having two ends and a varying pitch along a length of said spiral member being engaged with said follower for transforming the torque applied by said torsion spring into a second force between said one end of the torsion spring and one of said two ends of said spiral member as a function of said pitch along the length of the spiral member;

said one end of the spiral member being arranged for operative connection to the other of said window frame and the window sash to which said one end of the torsion spring is arranged for operative connection;

said two ends of the tension spring and said one end of the torsion together with said one end of the spiral member providing for combining the first and second forces into a total lifting force applied between the window sash and the window frame;

said pitch of the spiral member being varied along a first portion of said length of the spiral member for applying the total lifting force with a substantially constant magnitude throughout a more than one-half portion of the range of sash travel; and said pitch of the spiral member being further varied along a second portion of said length of the spiral member for applying the total lifting force with a substantially larger magnitude than the constant magnitude total lifting force within a remaining portion of the range of sash travel.

12. The multiple spring balance of claim 11 in which said pitch of the spiral member is yet further varied along a third portion of said length of the spiral member for applying a progressively increasing total lifting force from the constant magnitude total lifting force to the larger magnitude total lifting force within the remaining portion of the range of sash travel.

* * * * *